United States Patent [19]

Hollopeter et al.

[11] Patent Number: 4,932,874

[45] Date of Patent: Jun. 12, 1990

[54] SECURITY APPARATUS FOR RADIO FREQUENCY CABLE CONNECTIONS

[76] Inventors: Norman L. Hollopeter; David E. Rea, both of 1226 Wareman Ave., Pittsburgh, Pa. 15226

[21] Appl. No.: 347,003

[22] Filed: May 4, 1989

Related U.S. Application Data

[63] Continuation-in-part of Ser. No. 212,243, Jun. 27, 1988, abandoned.

[51] Int. Cl.[5] ..... H01R 13/44

[52] U.S. Cl. ..... 439/133; 439/306

[58] Field of Search ..... 439/133, 134, 304, 306, 439/308, 309

[56] References Cited

U.S. PATENT DOCUMENTS

| | | | |
|---|---|---|---|
| 2,519,979 | 7/1970 | Bodenstein | 339/85 |
| 3,467,763 | 9/1969 | Shaw | 439/133 |
| 3,845,454 | 10/1974 | Hayward et al. | 439/307 |
| 3,982,803 | 9/1976 | Bennett | 339/37 |
| 4,003,228 | 1/1977 | Lievens et al. | 70/58 |
| 4,080,029 | 3/1978 | St. Fort | 339/34 |
| 4,097,894 | 6/1978 | Tanner | 358/118 |
| 4,424,407 | 1/1984 | Barbic | 174/67 |
| 4,469,386 | 9/1984 | Ackerman | 439/133 |
| 4,479,688 | 10/1984 | Jennings | 339/37 |
| 4,603,931 | 8/1986 | Ruffman | 339/37 |
| 4,647,735 | 3/1987 | Sicher | 200/43.08 |
| 4,674,813 | 6/1987 | Feldner | 439/133 |
| 4,676,569 | 6/1987 | Lambert et al. | 439/133 |
| 4,705,335 | 11/1987 | Goebel | 439/133 |
| 4,740,168 | 4/1988 | Carney et al. | 439/133 |
| 4,782,971 | 11/1988 | Hill | 439/133 |
| 4,846,708 | 7/1989 | Marson et al. | 439/133 |

FOREIGN PATENT DOCUMENTS

| | | | |
|---|---|---|---|
| 2158662A | 11/1985 | United Kingdom | 339/82 |

*Primary Examiner*—P. Austin Bradley

*Attorney, Agent, or Firm*—W. F. Riesmeyer, III

[57] ABSTRACT

Security apparatus is provided for preventing theft or portable electrical and other equipment having connections for radio frequency cable or other types of cable thereon. The apparatus includes a substantially uncuttable flexible tubular member for receiving a cable therein. First and second elongated housing sleeves are mounted on opposed ends of the flexible tubular member for connection to the equipment and a separate base unit or a fixture. Each housing sleeve has a pair of parallel passages, a first of which receives the flexible tubular member therein and a second of which receives specially actuable rotatably operable locking means. According to this invention, a planar lip surrounding the first passage in each housing sleeve is retained in tightly abutted engagement with the equipment or the base unit or fixture as applicable so that no space is available for prying or tampering with the cable connections which are completely enclosed in the housing sleeves.

14 Claims, 8 Drawing Sheets

FIG. 15
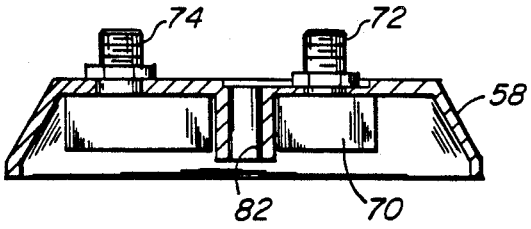
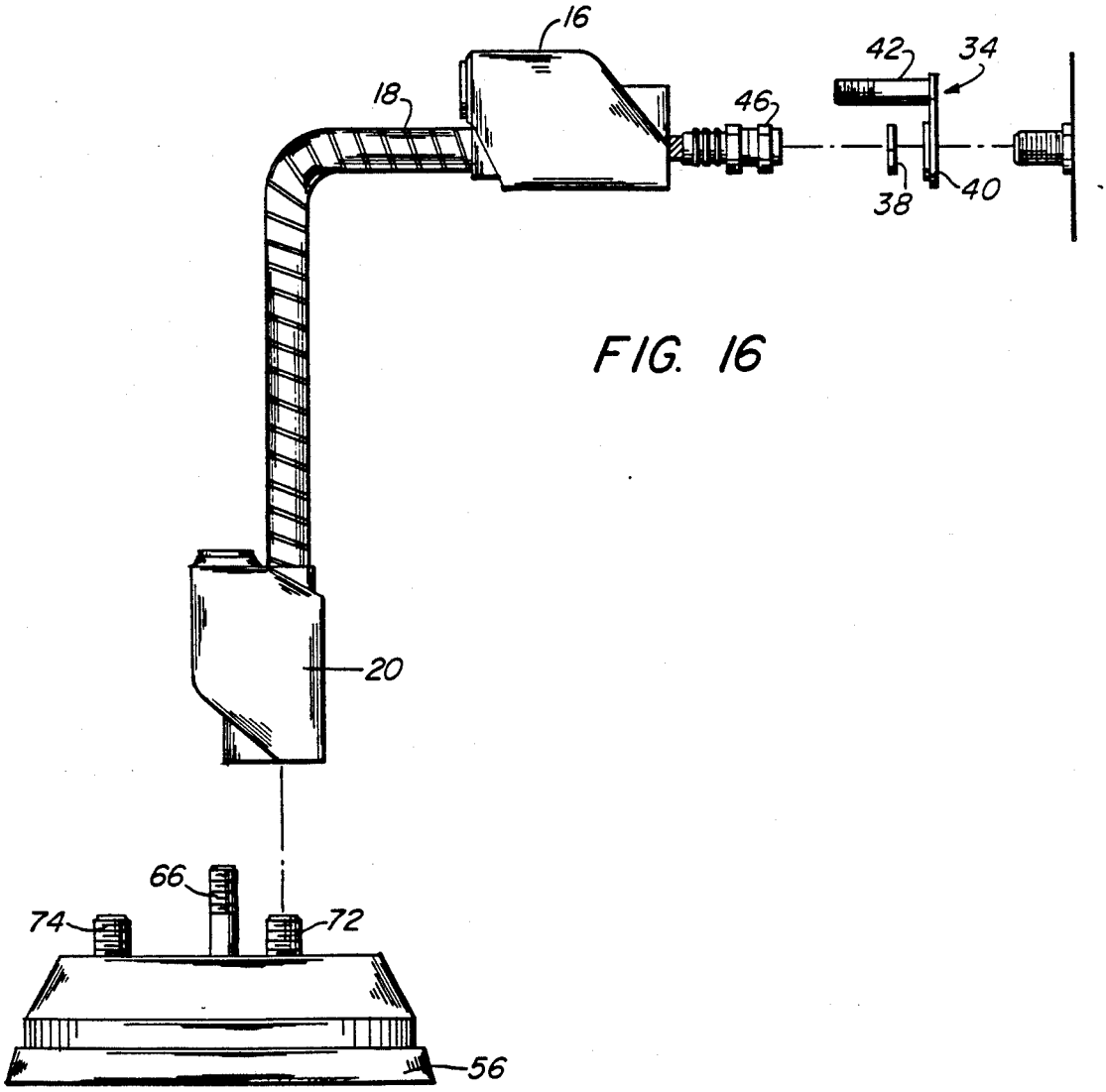
FIG. 16

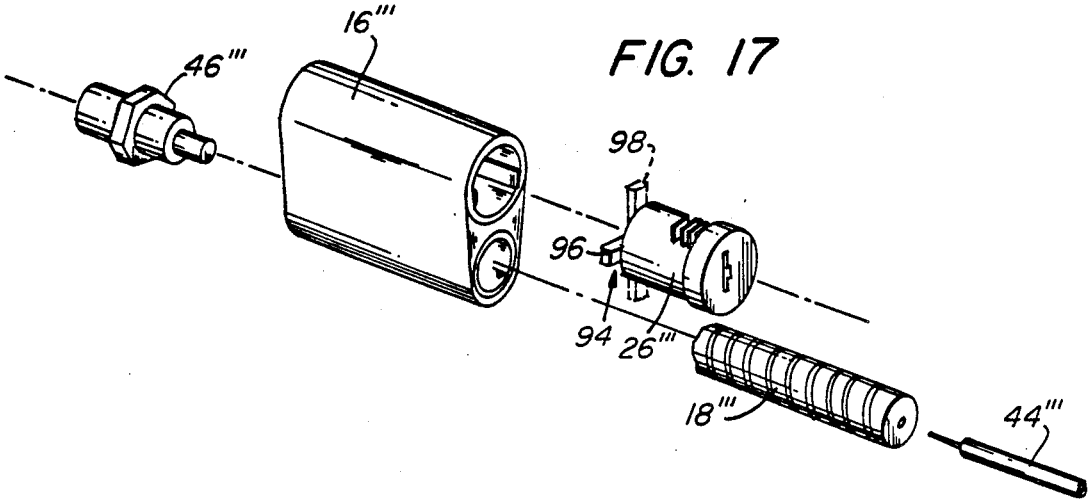
FIG. 17
FIG. 18
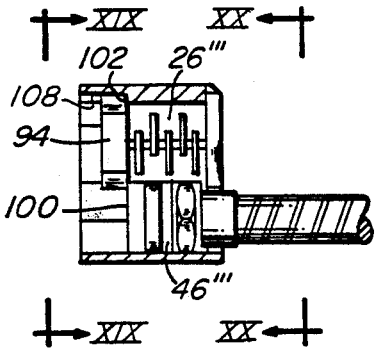
FIG. 19
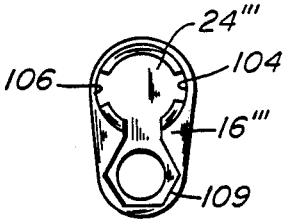
FIG. 20
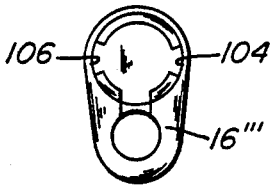

SECURITY APPARATUS FOR RADIO FREQUENCY CABLE CONNECTIONS

This application is a continuation-in-part of an earlier patent application, U.S. Ser. No. 07/212/243 filed June 27, 1988, now abandoned.

BACKGROUND OF THE INVENTION

This invention relates to apparatus for preventing theft of video cassette recorders, cable convertors, portable televisions, or other portable electrical equipment having radio frequency cable connections, and particularly to apparatus which can be readily connected to such electrical equipment without danger of electrical shock or damage to the equipment.

Prior theft prevention security apparatus has generally been directed to jacketing the power card and plugs at each end of the power cord. On some electric equipment, however, the power cord is not removable, that is it does not have a plug at the end connected to the equipment. Therefore, prior security apparatus cannot be used on such equipment. In addition, prior security apparatus also required creating new screw connections for attachment of the apparatus to the equipment. This can cause danger of electrical shock on high voltage equipment. Also there is potential for damage to the equipment itself.

U.S. Pat. No. 4,674,813 discloses security apparatus for electrical equipment including a jacket for the power cord and base and cover members for preventing unauthorized removal of enlarged plugs at each end of the cord from a wall outlet and the electrical equipment. This apparatus requires screwing the base members to the equipment and wall outlet. As mentioned above, this can be a significant disadvantage as to use with some high voltage equipment. Also, the cover members disclosed in this reference each have an elongated slot for receiving the power cord therethrough. The slot leaves substantial open space for insertion of a tool to pry or tamper with the device. Finally, unless several screws are used the covers themselves may be pried away from the wall outlet or equipment without significant damage to the outlet or the equipment. Various lockable cover devices for preventing removal of a plug from an electrical power outlet are disclosed in British Pat. No. 2,158,662 and U.S. Pat. No. 4,603,931; 4,479,688; 4,424,407 and 4,080,029. A separate box for enclosure of power connection plugs is disclosed in U.S. Pat. No. 4,647,735. A lockable device for securing a radio frequency cable connection on a citizens band radio is disclosed in U.S. Pat. No. 4,003,228. Various other secured cable connectors are disclosed in U.S. Pat. No. 3,519,979 and 3,982,803. Finally, a separate secured decoder filter having radio frequency cable connectors and a specially actuable lock is disclosed in U.S. Pat. No. 4,097,894.

It is a primary object of this invention to overcome the disadvantages of the prior art and provide a security apparatus for electrical equipment having at least one radio frequency cable connection and which does not require creation of screw holes in the equipment by the user and which completely encloses the radio frequency cable connector so as to prevent prying and tampering therewith.

SUMMARY OF THE INVENTION

A security apparatus is provided for preventing theft of electrical equipment having at least one connection for attachment of a radio frequency cable thereto. The apparatus includes a first elongated housing sleeve having a pair of longitudinal parallel passages extending therethrough. A substantially uncuttable flexible tubular member is mounted in a first of the passages and specially actuable rotatably operable locking means is mounted in a second of the passages. The first passage is adapted to receive a radio frequency cable connector mounted on a first end of the radio frequency cable. The first passage has an opening formed by a substantially planar lip surface for abutting tightly against a surface of the electrical equipment. Means is mounted on a second end of the flexible tubular member for lockably securing the second end of the tubular member to a surface of a fixture or essentially immovable equipment. The specially actuable locking means in said first housing sleeve may have a rotatable threaded member for threadedly engaging threaded means on said electrical equipment. Said threaded means being located adjacent to the connection for said radio frequency cable thereon. The tight fit of the lip surrounding the opening of the first passage in the first housing sleeve and the threaded member of the locking means therein prevent prying or tampering with said first housing sleeve. Alternatively the locking means may include cam means movable to alternate positions for selectively (i) abutting a surface of said radio frequency cable connector in the first of said passages in the first housing sleeve to prevent removal of the first housing sleeve from said electrical equipment and (ii) being disengaged from the abutted position against said surface to permit removal of the first housing sleeve from said electrical equipment.

In a preferred form, the means mounted on the second end of the flexible tubular member comprises a second elongated housing sleeve substantially the same as the first elongated housing sleeve. In this latter embodiment, a separate base unit may be provided. The separate base unit is adapted to be secured to a surface adjacent to the electrical equipment, for example, to a wall or floor surface or to a television console. The base unit provides at least one and preferably two connections for attachment of radio frequency cable thereto.

In an alternative embodiment especially adapted for use in computer applications, the security apparatus includes a flexible tubular member with first and second housing sleeves mounted on opposed ends of said flexible tubular member and a mid-line anchor device is provided for securing the flexible tubular member to a substantially immovable surface.

BRIEF DESCRIPTION OF THE DRAWINGS

FIG. 15 is a longitudinal cross section of the cap member taken at XV—XV of FIG. 12 and showing the radio frequency terminal unit in position therein.

FIG. 16 is a partially exploded side elevation view of the first and second housing sleeves, the separate base unit and the back portion of a video cassette recorder to which the first housing sleeve is adapted to be connected.

FIG. 17 is an exploded side elevation view of an alternate embodiment of the apparatus of this invention.

FIG. 18 is longitudinal vertical cross section of the first housing sleeve of FIG. 17 showing the locking means, radio frequency cable connector and flexible tubular member.

FIG. 19 is a view taken from XIX—XIX of FIG. 18.

FIG. 20 is a view taken from XX—XX of FIG. 18.

DESCRIPTION OF THE PREFERRED EMBODIMENT

Figure 1:
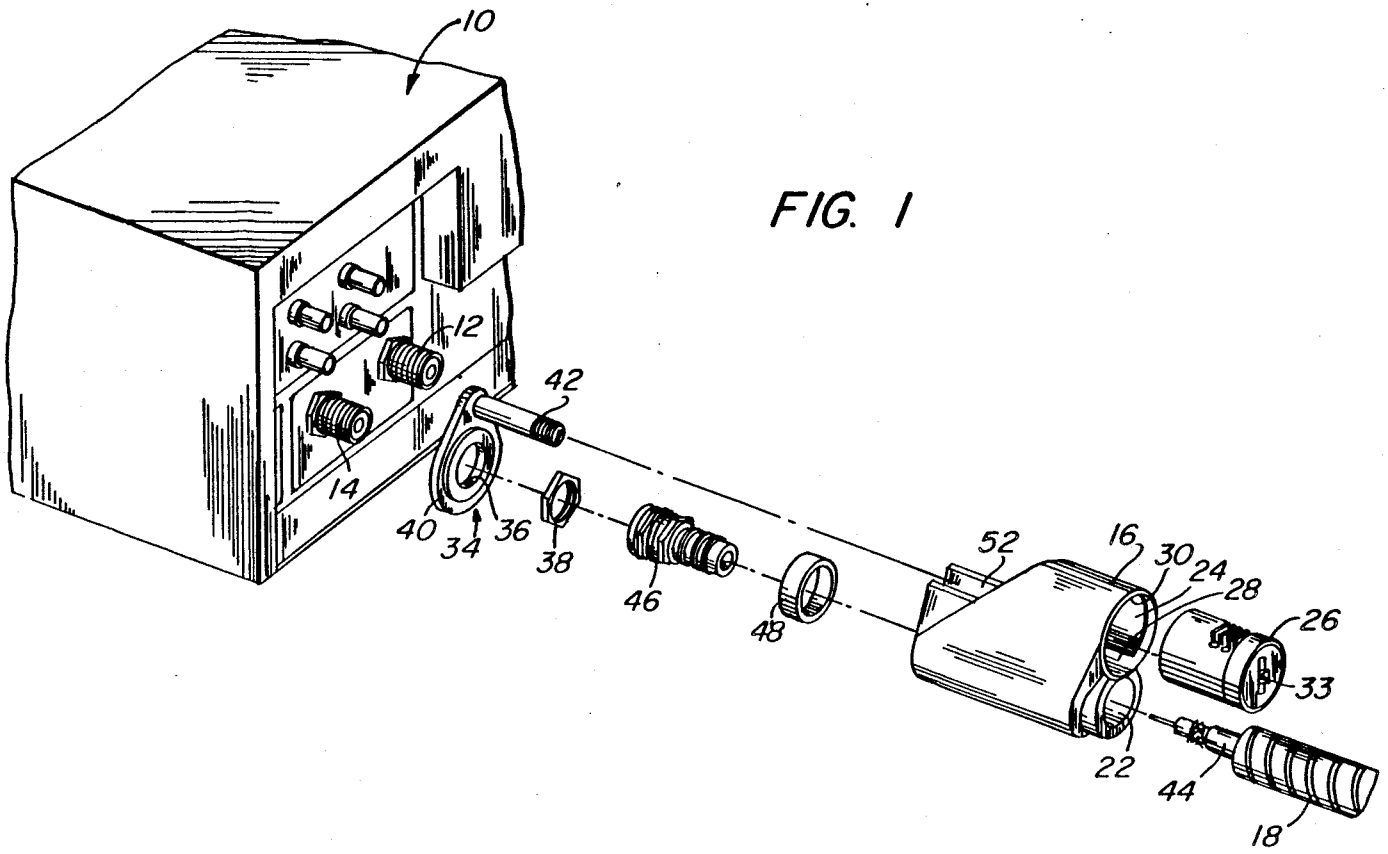
FIG. 1 is an exploded view of a portion of the apparatus of this invention and a back portion of a video cassette recorder to which it is adapted to be connected.

Referring to FIG. 1, a portion of the back of a video cassette recorder (VCR) 10 is shown. Conventionally, the VCR has an inlet connection 12 for radio frequency cable and an outlet connection 14 of the same type. The apparatus of this invention may be connected to either the inlet or outlet connections and from there to a console television or other fixture or as described below to a separate base unit secured to a floor, wall or other essentially immovable surface. The apparatus may be used to prevent theft of any electrical equipment having radio frequency cable connections such as portable televisions, cable convertors, or other such equipment. In addition, it may be used to prevent theft of computers having similar type connections as those just mentioned for attachment of shielded electronic signal wire thereto.

Figure 3:
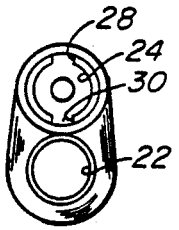
FIG. 3 is view taken at III—III of FIG. 2.
Figure 2:
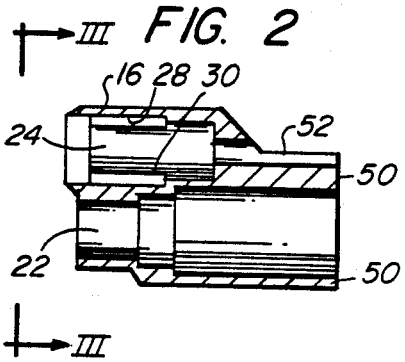
FIG. 2 is a longitudinal cross section of the first elongated housing sleeve shown in FIG. 1.
Figure 4:
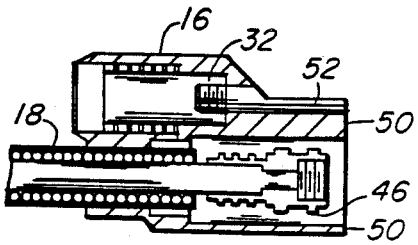
FIG. 4 is a longitudinal cross section of the first elongated housing sleeve showing the parts installed therein.
Figure 5:
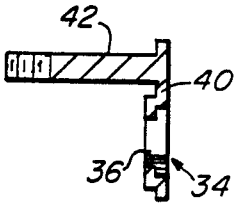
FIG. 5 is a longitudinal cross section of the adaptor for connection to the radio frequency cable connection of the VCR shown in FIG. 1.
Figure 7:
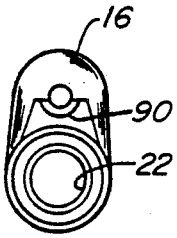
FIG. 7 is a view taken at VII—VII of FIG. 6.
Figure 6:
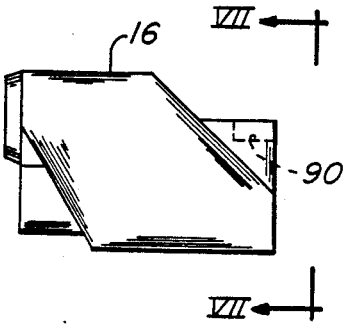
FIG. 6 is a side elevation view of a second embodiment of the first elongated housing sleeve.
Figure 8:
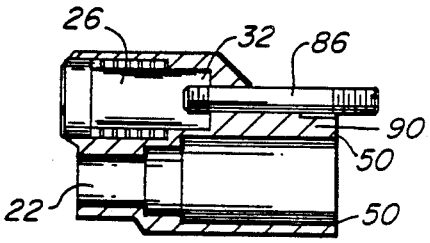
FIG. 8 is a longitudinal cross section of the first housing sleeve of FIG. 6 showing a modified form of locking means mounted therein.
Figure 9:
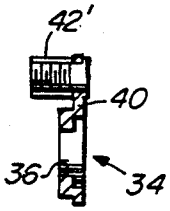
FIG. 9 is cross section of a modified form of adaptor to be utilized with the first housing sleeve and locking means shown in FIG. 8.
Figure 12:
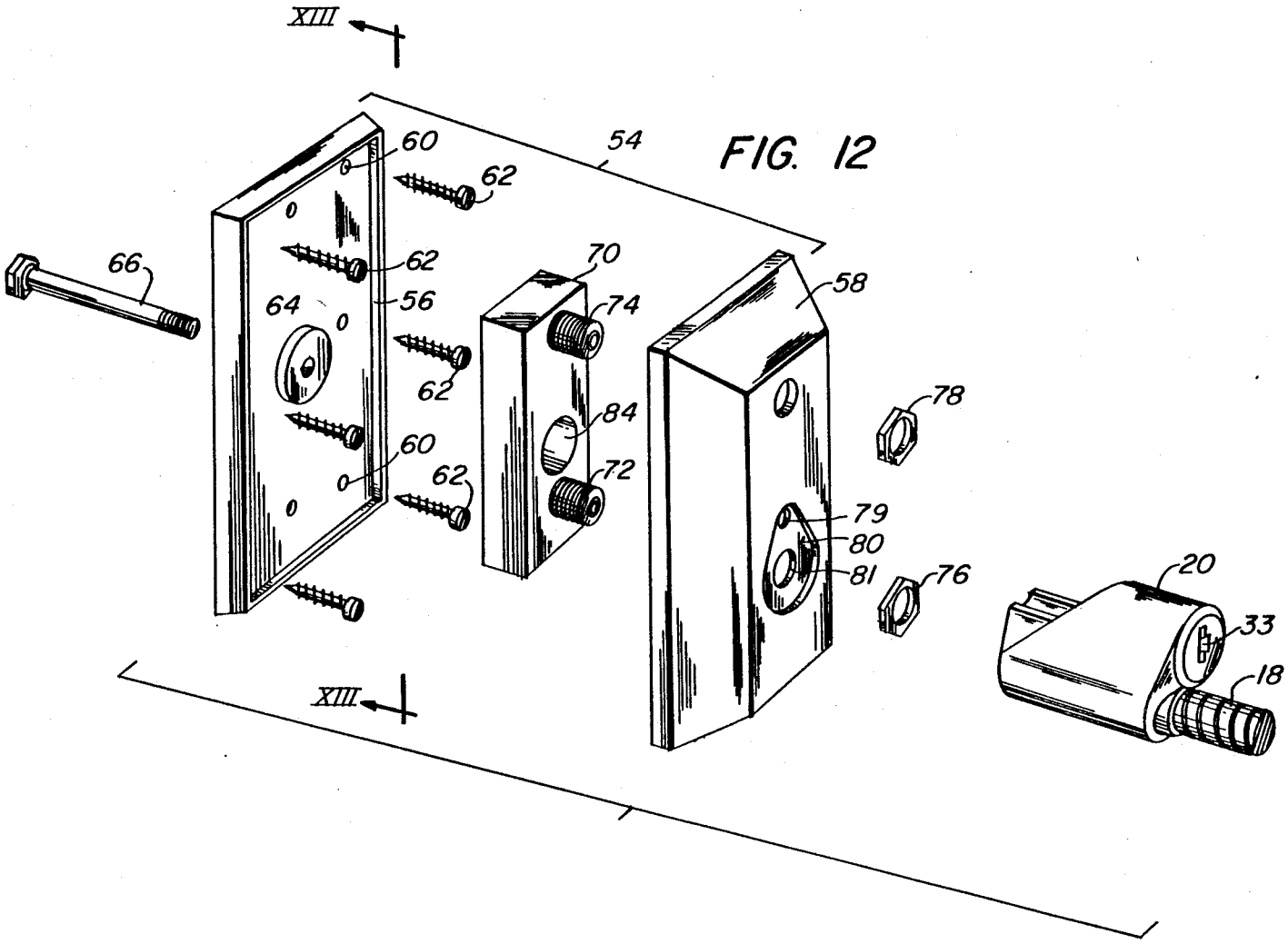
FIG. 12 is an exploded view of a second elongated housing sleeve and the separate base unit adapted to be secured to a wall, floor or other surface.

The apparatus of this invention includes a first elongated housing sleeve 16 (FIG. 1), a substantially uncuttable flexible tubular member 1, and a second elongated housing sleeve 20 (FIG. 12). The first elongated housing sleeve has a pair of longitudinal parallel passages 22 and 24 (FIG. 2) extending therethrough. The flexible tubular member 18 is mounted in a first of the passages 22 (FIG. 4). Specially actuable locking means 26 is mounted in a second of the passages. Tumbler grooves 28 and 30 (FIGS. 2 and 3) are provided in the second passage for receipt of tumblers of the locking means therein. According to this invention, the locking means is of special type for purposes described below. The locking means is rotatably operable and has a threaded member 32 (FIG. 4) for threaded engagement with threaded means 34 (FIG. 5) on the electrical equipment. This lock may be of a type which is key operated, having a keyhole 33 for insertion of a key therein, as is commercially available. The threaded means 34 may comprise an adaptor having a hole 36 permitting it to be directly installed on one of the radio frequency connections of the electrical equipment. It may be secured thereon by a nut 38 (FIG. 1). The adaptor includes a flange 40 having a threaded stud 42 protruding outwardly for engagement with the threaded member 32 of the locking means. Referring to FIGS. 1 and 4 a radio frequency cable 44 is mounted in the flexible tubular member. For computer applications as mentioned above, cable 44 is an electronic signal cable. For purposes of the claims, the term radio frequency cable is understood to include radio frequency cable, fiber optic cable and broadcast cable as well as electronic signal cable and interface cable of the type used in computer applications. A radio frequency cable connector 46 is mounted on a first end of cable 44 for attachment to a radio frequency connection of the electrical equipment. Generally, the flexible tubular member 18 and connector 46 are slidably movable in and through first passage 22. A retaining ring 48 (FIG. 1) may be installed on the flexible member to prevent it from being pulled out of the first housing sleeve. According to this invention, lip 50 of the first housing sleeve forms a substantially planar surface surrounding the opening of the first passage therein adjacent to the electrical equipment. This feature together with the threaded member of the locking means in the first housing sleeve provide a tight fit between the first housing sleeve and the electrical equipment completely enclosing the radio frequency cable connection of the electrical equipment. This prevents prying and tampering with the first housing sleeve since there is no room for insertion of a tool therebetween and any attempted tampering would damage or destroy the equipment.

Figure 13:
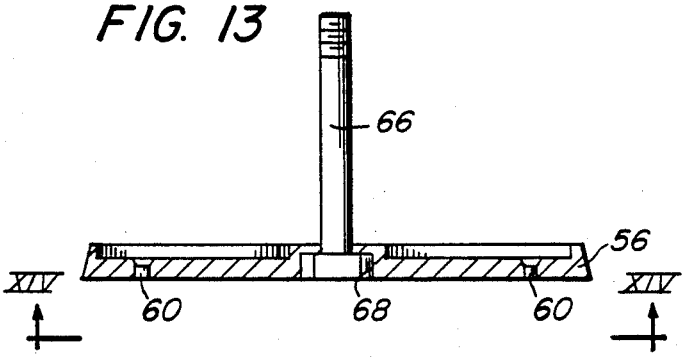
FIG. 13 is a longitudinal cross section taken at XIII—XIII of the plate in FIG. 12 and showing the threaded bolt mounted in the plate.
Figure 14:
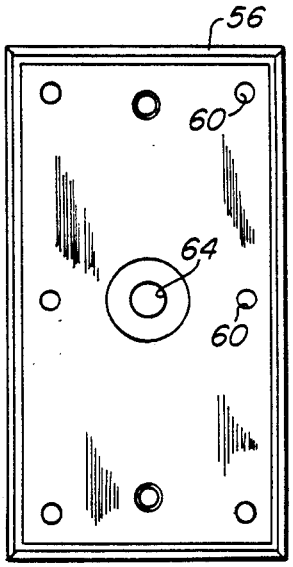
FIG. 14 is a view taken at XIV—XIV of FIG. 13.

Preferably, the first and second housing sleeves are of relatively lightweight substantially uncuttable material such as polycarbonate plastic nylon or die cast metal, such as titanium. The most preferred materials are the plastic and nylon due to lower cost. In a preferred form, the second passage 24 in the first housing sleeve has an open party cylindrical portion 52 to serve as a guide for the threaded stud 42 of the adaptor. Also, in a preferred form, the flexible tubular member comprises a conventional CE conduit which includes a steel encased high tensile strength carbon steel spring. Also, conventional BX electrical cable may be used. The flexible tubular member may be of other material, but is substantially uncuttable by manually operated cutting tools. The second housing sleeve 20 (FIG. 12) may be connected to a radio frequency connection on a console television (since the latter is relatively immovable) or it may be connected to a separate base unit 54 (FIG. 12). Second housing sleeve 20 preferably has identical shape and parts including specially actuable locking means of the same type as the first housing sleeve as described above. Base unit 54 includes a plate member 56 and cap member 58. Plate member 56 has a plurality of screw holes 60 for insertion of screws 62 to secure the plate to a wall or floor surface or the surface of a relatively immovable fixture. A central hole 64 is provided for insertion of threaded bolt 66 therethrough. A hexagonally shaped hole 68 (FIG. 13) is provided on the outer surface of the plate for mateably receiving the head of bolt 66 therein to prevent turning of the bolt. A radio frequency terminal unit 70 (FIG. 12) is adapted to be mounted within cap member 58 as shown in FIG. 15. The terminal unit 70 has two radio frequency connections 72 and 74 thereon. Nuts 76 and 78 may be used to secure the terminal unit to cap member 56. Cap member 56 preferably has a countersunk area 80 for mateably receiving the end of second housing sleeve 20 in close fitting engagement therewith. Holes 79 and 81 are provided in the cap member for receipt of threaded bolt 66 and radio frequency connection 72 therethrough. Hole 83 is provided for receipt of radio frequency connection 74 therethrough. Cap member 56 also has tubular portion 82 (FIG. 15) for protruding through hole 84 in radio frequency terminal unit 70. Tubular portion 82 also allows threaded bolt 66 to extend through cap member 56 for engagement with the threaded member of the locking means in the second housing sleeve.

In an alternative embodiment shown in FIGS. 6 through 9, the locking means in the first housing sleeve further comprises a threaded stud 86 mounted in the internally threaded member thereof. The adaptor shown in FIG. 9 for attachment to a radio frequency connection of the electrical equipment has an internally threaded tubular portion 42' for engagement with threaded stud 86. A countersunk cut out portion 90 (FIGS. 6 and 7) is provided at the end of the second passage in the housing sleeve for receiving the tubular portion of the adaptor therein.

Figure 10:
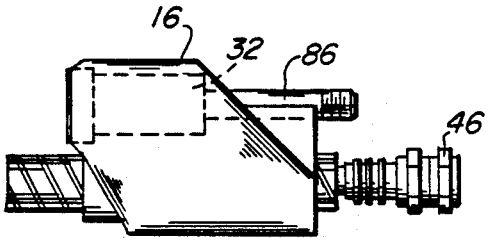
FIG. 10 is a side elevation view of the modified form of first housing sleeve shown in FIG. 8.
Figure 11:
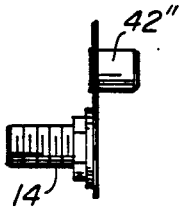
FIG. 11 is a side elevation view of an alternative embodiment of threaded means for installation by the manufacturer of a VCR to permit threaded engagement by the locking means of said first housing sleeve therewith.

In still another embodiment shown in FIGS. 10 and 11 threaded stud 86 is mounted in the internally threaded member of the locking means in the first housing sleeve. An internally threaded tubular member 42'' is provided by the electrical equipment manufacturer as original equipment on the VCR, cable converter or computer, etc. adjacent to a radio frequency connection thereon for receipt of threaded stud 86 of the security apparatus of this invention. This latter embodiment eliminates the need for the user to install an adaptor on the radio frequency connection itself.

In operation for using the security apparatus of this invention with a VCR, an adaptor is installed on a radio frequency connection of the VCR. Where a separate base unit is used a threaded bolt is installed in the plate member and the plate member is secured to a wall or floor (FIG. 16) near the VCR. The radio frequency terminal unit and cap member are installed on the plate member of the base unit. Then the radio frequency cable connectors at opposed ends of the cable are attached to the radio frequency connections of the VCR and base units, respectively. A key is inserted in the locking means of the first and second housing sleeves and turned so as to cause engagement of the threaded member of the locking means with that of the adaptor. The key is continually rotated until the housing sleeves are held tightly against the VCR and base unit so as to prevent unauthorized disconnection of the radio frequency cable connectors therefrom.

Additional alternative embodiments are described below in which the locking means is slidably or rotatably movable but does not have a threaded member for providing the tight fit required between the first housing sleeve and the electrical equipment. For these latter embodiments parts similar to those previously described are all designated with a triple prime superscript. In a first of these alternative embodiments shown in FIGS. 17 through 20, the locking means 26''' in the first housing sleeve 16''' comprises a plug lock having a rotatable cam 94. Cam 94 may be integral with the plug lock or separately attached to it by a cap screw. Again the lock is actuable by a key for rotating the cam selectively to alternate positions 96 and 98 (FIG. 17). In position 98 cam 94 abuts surface 100 of radio frequency cable connector 46''' (FIG. 18) and surface 102 of the first housing sleeve so as to lock the first housing sleeve tightly against the VCR or other electrical equipment. The first housing sleeve has diametrically opposed slots 104 and 106 in the second of the passages 24''' for receipt of the cam 94 of locking means 26''' upon insertion of the locking means in said second passage. When the locking means is fully inserted in the second passage cam 94 can be rotated to positions 96 and 98 in an enlarged end portion 108 of the second passage. The first passage in said first housing sleeve must have a hexagonal shape 109 in a portion thereof coextensive with the part of said radio frequency cable connector immediately adjacent to an end secured in the flexible tubular connector. It should be noted that of the standard radio frequency cable connectors now available only those having a hexagonal shaped periphery on the part adjacent to the flexible tubular member as just mentioned can be used. Those with a round portion on that part cannot be used in this embodiment with the plug lock. The reason is that with a round cable connector part adjacent to the flexible tubular member the first housing sleeve conceivably could be rotated to unscrew the cable connector from the VCR or other electrical equipment. This cannot be done with a hexagonal part adjacent to the cable connector and a hexagonally shaped portion for that part in the first passage. Attempted rotation of the first housing sleeve turns the cable connector more tightly against the flexible tubular member and rotation is prevented due to resistance of the flexible tubular member to such rotation.

Figure 27:
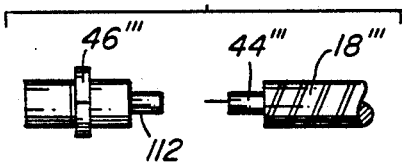
FIG. 27 is a partially exploded side view of the radio frequency cable connector and flexible tubular member of FIG. 18.

Referring to FIG. 27, a modified version of the connection between radio frequency cable connector 46''' and uncuttable flexible tubular member 18''' and radio frequency cable 44''' is shown. In this version, radio frequency cable connector 46''' has an externally threaded end 112 of modified thread configuration which is adapted to threadedly engage the interior of the flexible tubular member 18''' which in this version may be conventional CE conduit, BX electrical cable or other material forming an internally threaded surface.

Figure 22:
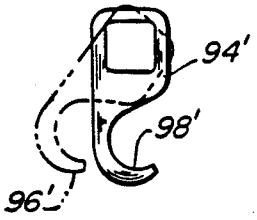
FIG. 22 is a view taken at XXII—XXII of the cam shown in FIG. 21.
Figure 21:
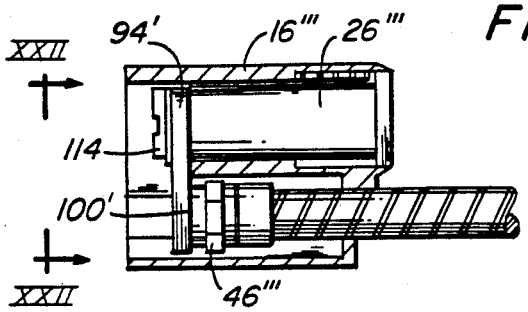
FIG. 21 is a longitudinal vertical cross section of the first housing sleeve in still another embodiment of this invention.
Figure 23:
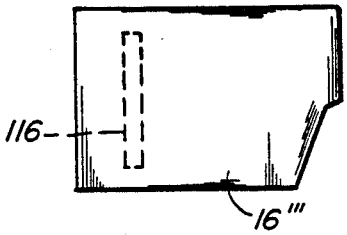
FIG. 23 is a side view of the first housing sleeve of FIG. 21.

In still another alternative embodiment shown in FIG. 21 through 23, locking means 26''' is rotatably movable and has a rotary hook cam 94' attached thereto by cap screw 114. A slot opening 116 (FIG. 23) is provided in one side of first housing sleeve 16''' to permit rotatable movement of cam 94' from alternate positions 96' and 98' (FIG. 22). Again as in the immediate previously mentioned embodiment, in position 98' cam 94 abuts surface 100' of radio frequency cable connector 46''' so as to lock the first housing sleeve tightly against the electrical equipment. Preferably rotary hook cam 94' fits flush with the outer surface of first housing sleeve 16''' when in the locking position 98' and fits closely in slot opening 116 to prevent prying and tampering with the device.

Figure 25A:
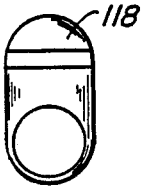
FIG. 25A is a view taken at XXVA—XXVA of FIG. 25.
Figure 25:
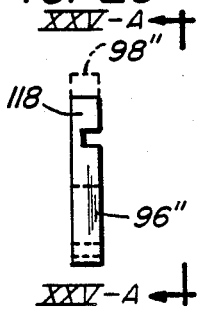
FIGS. 25 is a side view of the sliding bar cam shown in FIG. 24.
Figure 24:
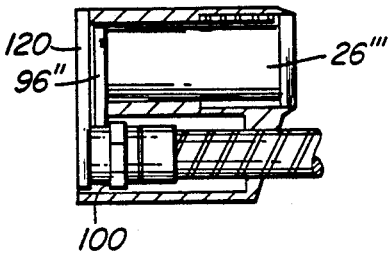
FIG. 24 is a longitudinal vertical cross section of a first housing sleeve in another embodiment of this invention.
Figure 26B:
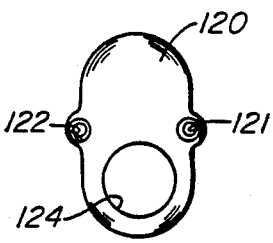
FIG. 26B is a view taken at XXVIB - XXVIB of FIG. 26.
Figure 26:
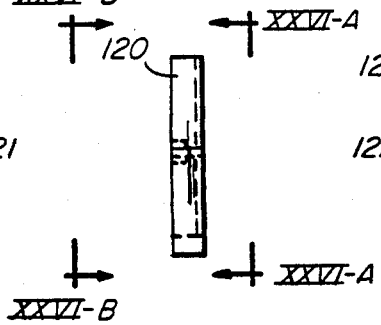
FIG. 26 is a side view of the cap for closing the first housing sleeve of FIG. 24.
Figure 26A:
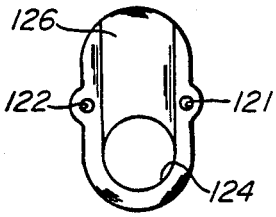
FIG. 26A is a view taken at XXVIA—XXVIA of FIG. 26.

In still another embodiment shown in FIGS. 24 through 26, locking means 26''' is of the draw bolt type and has a slidably movable bar 118 which is movable upwardly and downwardly within first housing sleeve 16'''. The first housing sleeve 16''' has a joined portion of the first and second elongated passages for permitting the just mentioned movement of bar 118. A cap 120 (FIG. 26) is attached to the first housing sleeve 16''' by screws (not shown) in holes 121 and 122. Cap 120 has a large opening 124 for receipt of the cable connector therethrough. Preferably cap 120 has a groove 126 on its inner face for guiding slidable movement of bar 118 upwardly and downwardly in the first housing sleeves. Bar 118 moves upwardly and downwardly to alternate positions 96'' and 98'' so as to abut surface 100'' of radio frequency cable connector 46''' in position 98'' and to become disengaged therefrom in position 96'' the same as in the two immediately preceding embodiments.

Figure 28:
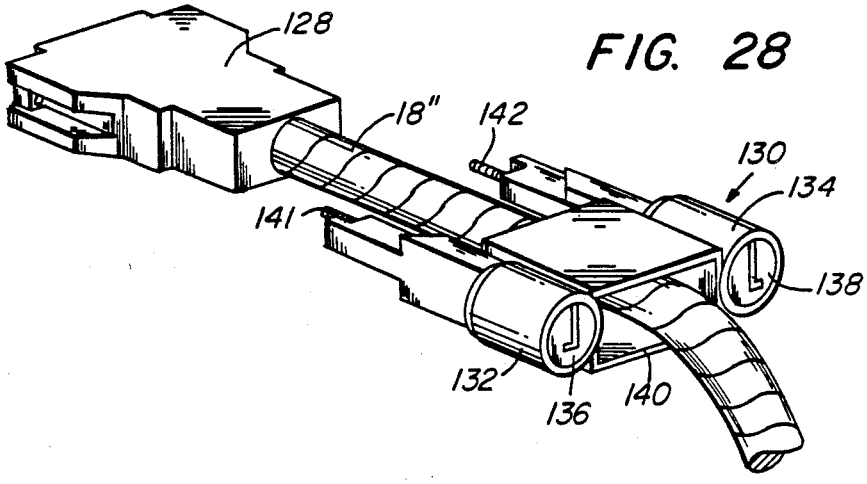
FIG. 28 is a partially exploded isometric view of an alternate embodiment of this invention for use in computer applications.
Figure 32:
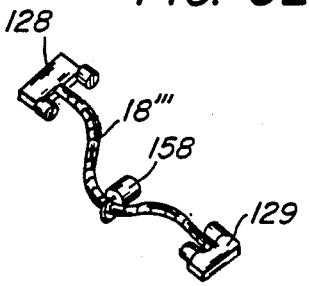
FIG. 32 is an isometric view of the apparatus of this invention for computer applications.

Finally, an embodiment for computer applications is shown in FIG. 28. A conventional plug 128 is shown for attachment to a computer terminal. The shielded electronic signal wire is covered by a substantially uncuttable flexible tubular member 18''' as in other applications previously described. A second plug (129) (FIG. 32) is connected to the opposite end of the flexible tubular member. The second plug may be connected for example to a printer or other equipment. First and second housing sleeves of identical type are provided at opposed ends of the flexible tubular member. In FIG. 28, first housing sleeve 130 comprises a pair of housing sleeves 132 and 134 each having an elongated passage for receipt of locking means 136 and 138 therein. A rectangular hollow housing 140 joins the housing sleeves 132 and 134. Each locking means has a rotatable threaded member 141 and 142 for engagement with conventional threaded means on the computer terminal (not shown). The rotatable threaded members 141 and 142 replace the conventional screws normally used to attach the plugs to the computer terminal and printer. The locking means serve to retain the plugs in the connected position and prevent tampering or unauthorized removal of the plugs. The plug 128 and first housing sleeve 130 may be molded as an integral part if desired.

Figure 29:
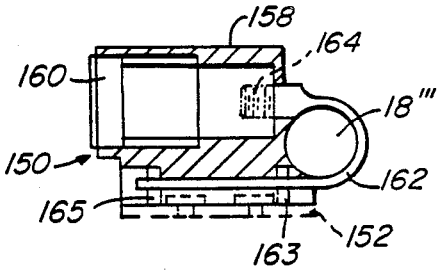
FIG. 29 shows a longitudinal vertical cross section of a mid-line anchor which may be used in computer applications.
Figure 30:
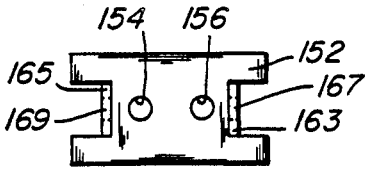
FIG. 30 is a plan view of the base of the mid-line anchor device.
Figure 31:
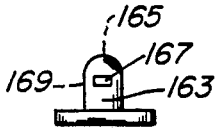
FIG. 31 is a side elevation view of the base shown in FIG. 30.

A separate mid-line anchor or lock down 150 is shown in FIG. 29. The mid-line anchor may be secured to a wall, floor or furniture to prevent theft of the computer, printer and other equipment. A base plate 152 is provided with two holes 154 and 156 for receipt of screws to secure the base plate to the wall, floor or furniture surface. A first elongated housing sleeve 158 is also provided and has an elongated passage for receipt of locking means 160 therein. The first housing sleeve is secured to the base plate 142 by locking clip 162 which extends through upright arms 163 and 165 each of which have holes 167 and 169 for receiving locking clip 162 therethrough. Of course other means may be used to secure the first housing sleeve to the base plate, such as screws, spring clips or other connections. The locking means 160 is rotatably actuable and has an internally threaded portion for receipt of a threaded end 164 of locking clip 154 therein. By rotation of a key in locking means 160, locking clip 162 is drawn more tightly against the surface of flexible tubular member 18''' to clamp against the tubular member. The locking means may be rotated in the opposite direction to loosen locking clip 162 and permit movement of the tubular member.

It will be apparent to those skilled in the art that other alternative embodiments and parts may be used in the apparatus of this invention. For example, a number of suitable specifically actuable locking means may be used. The locking means may be key operated or of the combination type. barrel-type combination locks are especially suitable for use in this invention. For example, the wide end of a female portion of the barrel lock might be tapped and threaded and the male portion could be drilled to create a through passage therein for the wire or cable. In this embodiment, only a single longitudinal passage would be required in the first housing sleeve. A single longitudinal passage would also be suitable as well in other embodiments with different locking means. Various other locks with different parts and other manner of operation may be used besides those particularly described and shown herein. The apparatus of this invention also has applications in fields other than for use with electrical equipment. For example, the flexible tubular member may be used with another type of cable and cable connector or even without any cable located internally therein. For purposes of the claims it is to be understood that the security apparatus of this invention may be used with other types of equipment and with or without a cable within the flexible tubular member, except as required for use with certain locking means adapted to accomplish the locking function by becoming abutted against the surface of a cable connector attached to a cable within the flexible tubular member.

We claim:

1. A security apparatus for preventing theft of electrical equipment having at least one connection for attachment of a radio frequency cable thereto, said apparatus comprising:

a first elongated housing sleeve having a pair of parallel longitudinal passages extending therethrough, a substantially uncuttable flexible tubular member having a first end thereof mounted in a first of the passages in the first housing sleeve, said flexible tubular member being adapted to receive a radio frequency cable therein, said first of the passages in said first housing sleeve being adapted to receive therein a radio frequency cable connector mounted on a first end of said radio frequency cable, said first passage in the first housing sleeve having a substantially planar lip for tightly engaging a surface of the electrical equipment so that said first passage completely encloses the connection for said radio frequency cable therein when the planar lip is abutted against said surface of the electrical equipment, means on a second end of said flexible tubular member for lockably securing the second end of said tubular member to a substantially immovable surface adjacent to said electrical equipment, a specially actuable, rotatably operable locking means mounted in a second of the passages in said first housing sleeve, said specially actuable locking means having a rotatable threaded member for threadedly engaging threaded means on said electrical equipment located adjacent to the connection for said radio frequency cable thereon, said threaded member being operable to draw the first housing sleeve into close engagement with the electrical equipment and to retain said first housing sleeve in said position.

2. The security apparatus of claim 1 where in the threaded means on said electrical equipment comprises a threaded stud protruding outwardly therefrom adjacent to the connection for said radio frequency cable thereon.

3. The security apparatus of claim 2 wherein the threaded stud is mounted on an adaptor having a flange with a hole therethrough permitting mounting of the adaptor on said connection, said threaded stud protruding outwardly from the flange of said adaptor.

4. The security apparatus of claim 2 wherein the second of the elongated passages in said first housing sleeve has a partially exposed part cylindrical portion adjacent to the electrical equipment and adapted to serve as a guide for the threaded stud therein.

5. A security apparatus for preventing theft of electrical equipment having at least one connection for attachment of a radio frequency cable thereto, said apparatus comprising:

first and second elongated housing sleeves, each having a pair of parallel longitudinal passages extending therethrough, a substantially uncuttable, flexible tubular member having opposed ends thereof mounted in a first of the passages in each of the first and second housing sleeves, said flexible tubular member being adapted to receive a radio frequency cable therein, said first of the passages in each of the first and second housing sleeves bring adapted to receive therein a radio frequency connector on each end of the radio frequency cable, said first of the passages in each of the first and second housing sleeves each having a substantially planar lip for tightly engaging a surface of the electrical equipment and a surface of a substantially immoble fixture, respectively, so that said first passages completely enclose the connections for said radio frequency cable when said planor lips are engaged with said surfaces, a specially actuable, rotatably operable locking means mounted in a second of the passages in each of the first and second housing sleeves, said locking means of the first and second housing sleeves each having a rotatable threaded member for threadedly engaging threaded means on said electrical equipment and said substantially immovable fixture, respectively, said threaded members of the locking means in said first and second housing sleeves being operable to draw the first and second housing sleeves into close fitting, tightly abutted engagement with said electrical equipment and said fixture.

6. The security apparatus of claim 5 further comprising a separate base unit for attachment of the second housing sleeve thereto, said base unit including a plate member adapted to be secured to a surface adjacent to the electrical equipment, a radio frequency terminal unit adapted to be mounted on the plate member, said radio frequency unit having at least one connection for attachment of radio frequency cable thereto, a cap member for mounting on said plate member and adapted to cover said radio frequency terminal unit, said cap member having a passage for protrusion of the connection on said radio frequency terminal unit therethrough, said separate base unit having threaded means therein adapted to threadedly engage the threaded member of the locking means in said second housing sleeve.

7. A security apparatus for preventing theft of equipment having at least one connection for attachment of a cable thereto, said apparatus comprising:

a first elongated housing sleeve having at least one longitudinal passage extending therethough.

a substantially uncuttable flexible tubular member having a first end thereof mounted in the longitudinal passage in said first housing sleeve, said flexible tubular member being adapted to receive a cable therein, said longitudinal passage being adapted to receive therein a cable connector mounted on the first end of said cable, the first housing sleeve having a perpheral substantially planar lip bounding at least a major portion of the periphery of the longitudinal passage for tightly engaging a surface of the equipment, means on a second end of the flexible tubular member for securing the second end of said flexible tubular member to a substantially immovable surface adjacent to said equipment, and a specially actuable, locking means mounted in the longitudinal passage in the first housing sleeve for selectively maintaining the first housing sleeve in close fitting tightly abutted engagement with said equipment, said locking means having a longitudinal passage for receipt of the cable therethrough.

8. The security apparatus of claim 7 wherein said first housing sleeve has at least a pair of paralled longitudinal passages extending therethrough, the first end of substantially uncuttable flexible tubular member being mounted in a first of the longitudinal passages in the first housing sleeve, said specially actuable, locking means being mounted in a second of the passages in said first housing sleeve, the first housing sleeve having a peripheral substantially planar lip bounding at least a major portion of each of the first and second longitudinal passages in the first housing sleeve for tightly engaging a surface of the equipment.

9. The security apparatus of claim 8 wherein said specially actuable locking means includes cam means movable to alternate positions for selectively (i) abutting a surface of said cable connector in the first of said passages in the first housing sleeve to prevent removal of the first housing sleeve from said equipment and (ii) being disengaged from the abutted position against said surface to permit removal of the first housing sleeve from said equipment.

10. The security apparatus of claim 9 wherein said specially actuable locking means is rotatably operable and said cam means is enclosed within said first housing sleeve and movable within said first housing sleeve to said alternate positions.

11. The security apparatus of claim 9 wherein said specially actuable locking means is rotatably operable and said cam means is rotatably movable to said alternate positions.

12. A security apparatus for preventing theft of equipment having at least one connection for attachment of a cable thereto, said apparatus comprising:

first and second elongated housing sleeves, each having at least two parallel longitudinal passages extending therethrough, a substantially uncuttable, flexible tubular member having opposed ends thereof mounted in a first of the passages in each of the first and second housing sleeves, said flexible tubular member being adapted to receive a cable therein, said first of the passages in each of the first and second housing sleeves being adapted to receive therein a connector on each end of the cable, said first of the passages in each of the first and second housing sleeves each having a substantially planar surface for tightly engaging a surface of equipment so that said first passages completely enclose the connections for said cable when said planar lips are engaged with said equipment, a specially, actuable, locking means mounted in a second of the passages in each of the first and second housing sleeves, said locking means being operable to retain the first and second housing sleeves into close fitting, tightly abutted engagement with said equipment.

13. The security apparatus of claim 12 further comprising mid-line lock down means for securing said flexible tubular member to a substantially immovable fixture.

14. The security apparatus of claim 13 wherein said mid-line lock down means comprises a third housing sleeve having an elongated passage therein and means for securing said third housing sleeve to the substantially immovable fixture, said third housing sleeve having specially actuable locking means in the elongated passage therein and bracket means connected to said specially actuable locking means for alternately clamping and releasing said substantially uncuttable flexible tubular member to and from said third housing sleeve.

* * * * *